US005163607A

United States Patent [19]

Kuhn et al.

[11] Patent Number: 5,163,607

[45] Date of Patent: Nov. 17, 1992

[54] MULTIPACK MADE FROM BOARD

[75] Inventors: Werner Kuhn, Buchenberg; Rudolf Kraus, Osterreinen, both of Fed. Rep. of Germany

[73] Assignee: Van den Bergh Foods Co., Div. of Conopco, Inc., New York, N.Y.

[21] Appl. No.: 477,789

[22] Filed: Feb. 9, 1990

[30] Foreign Application Priority Data

Feb. 9, 1989 [DE] Fed. Rep. of Germany ..... 3903795

[51] Int. Cl.[5] ..... B65D 5/48

[52] U.S. Cl. ..... 229/40; 206/140; 206/427

[58] Field of Search ..... 229/40; 206/140, 427, 206/434

[56] References Cited

U.S. PATENT DOCUMENTS

| | | | |
|---|---|---|---|
| 2,867,320 | 1/1959 | Andre | 206/140 |
| 3,300,119 | 1/1967 | Chaussadas . | |
| 3,314,590 | 4/1967 | Tolaas | 206/140 |
| 3,372,800 | 3/1968 | Arneson | 229/40 |
| 3,472,370 | 10/1969 | Morgese | 229/40 |
| 3,598,302 | 8/1971 | Nowak | 229/40 |
| 3,747,835 | 7/1973 | Graser . | |
| 4,381,057 | 4/1983 | Carver | 206/434 |
| 4,489,880 | 12/1984 | Calvert | 206/434 |
| 4,703,847 | 11/1987 | Oliff | 206/434 |

FOREIGN PATENT DOCUMENTS

| | | | |
|---|---|---|---|
| 773923 | 12/1967 | Canada | 229/40 |
| 332153 | 9/1989 | European Pat. Off. . | |
| 1436066 | 3/1966 | France . | |
| 1466872 | 12/1966 | France . | |

OTHER PUBLICATIONS

A copy (in German) of Nov. 3, 1989 letter from the Deutsches Patentanwalt.

*Primary Examiner*—Gary E. Elkins
*Attorney, Agent, or Firm*—Ronald A. Koatz

[57] ABSTRACT

Board multipack for at least four tub-like objects with rims that are arranged in two rows, with a top panel (2), two side panels (5,6) and a base panel which consists of two sections (9,10) that overlap. The outer of the two base sections is provided with a tab (17) which is die-cut from the section (10) and is hinged to the same along a folding line. The inner base section (9) has two hinged flaps (13,14) that each have a cut-out section (15,16) in the middle, which the tab (17) engages and locks with.

3 Claims, 2 Drawing Sheets

MULTIPACK MADE FROM BOARD

DESCRIPTION

Figure 1:
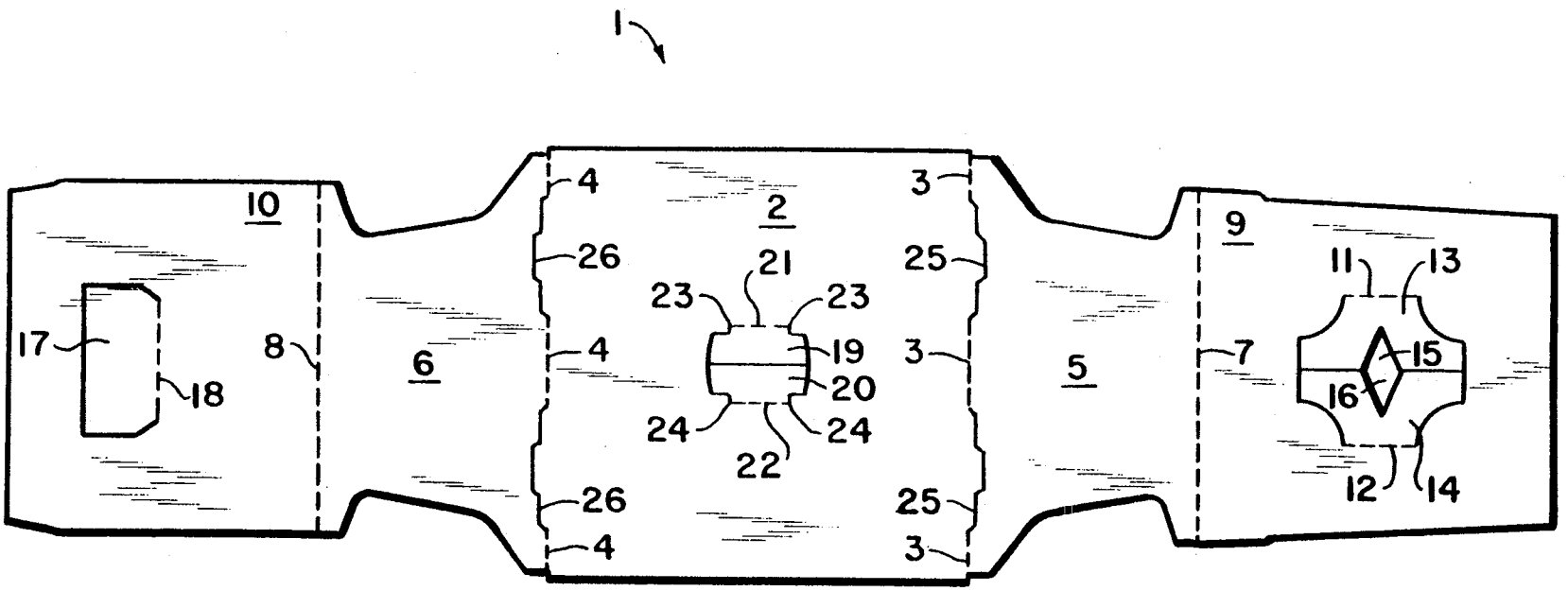

The invention relates to a multipack made from board or a similar material for at least four tub-like objects with rims that are arranged in two rows, with a top panel, two side panels and a base panel which consists of two sections that overlap at least to some extent, cuts which the rims of the tub-like objects engage being provided in the folding lines between the two side panels and the top panel.

Numerous multipacks of this kind are in common use and secure the tub-like objects in position extremely effectively.

Problems have, however, arisen when one-row and two-row multipacks are supposed to be erected alternately on a single packaging machine. With the packaging solutions disclosed in the past this has only been possible—if at all—if considerable machine modifications are made.

The purpose of the invention is to design a multipack of the kind outlined above in such a way that it can be erected without any difficulty on a machine on which one-row packs can also be erected.

In the solution to this problem proposed by the invention the outer of the two sections forming the base is provided with a tab which is die-cut from the base section and is hinged to the same along a folding line. The inner base section has two hingd flaps that face each other and each have a cut-out section in the middle, which the tab of the outer section engages and locks with when the tabs and flaps are folded between the tub-like objects.

This makes it possible to erect one-row and two-row packs in exactly the same way, so that only the width of the machine has to be changed, which is a very simple operation. All that needs to be done with the two-row multipack then is to press the tab and flaps inwards in a subsequent operation.

In an advantageous further development of the invention, the top panel is provided in the middle with two hinged flaps that face each other, are die-cut from the top panel and engage the area between the rims of the tub-like objects when they are pressed inwards towards the centre of the multipack.

These flaps in the top panel help to hold the tub-like objects more securely, so that they remain in place even if the packs are not treated properly.

It is particularly advantageous if in accordance with the invention the two flaps in the top panel are provided on both sides of the line with which they are hinged to the top panel with a projection with which they engage the rims of the tub-like objects.

This enables the flaps to lock very effectively so that the objects cannot slip out unintentionally.

Figure 2:
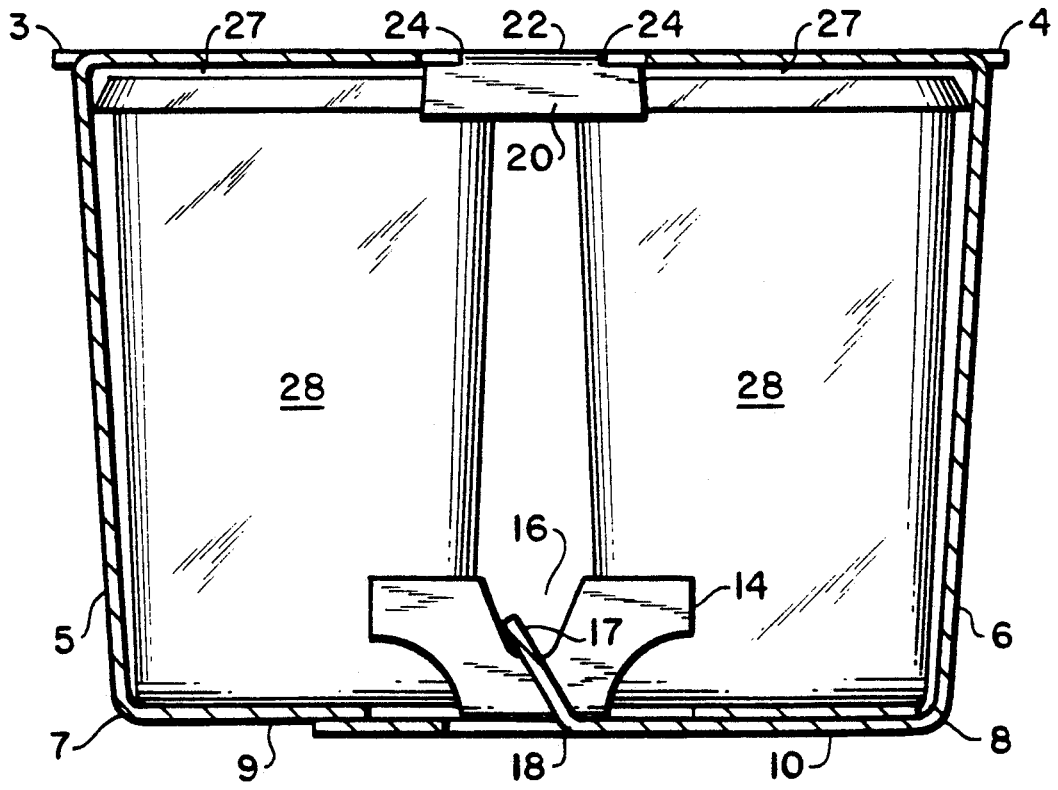

One embodiment of the invention is illustrated in the drawings:

FIG. 1 shows a flat board blank for the production of a multipack for tub-like objects and FIG. 2 shows the erected multipack filled with tub-like objects.

1 in FIG. 1 is a flat board blank which has a top panel 2 to which two side panels 5/6 are hinged along two folding lines 3/4. Each of the two side panels 5 and 6 is provided with one section 9, 10 of a base along folding lines 7/8. Two flaps 13 and 14 that face each other are hinged to section 9 of the base along two folding lines 11 and 12. These flaps 13 and 14 are die-cut from the material of the base section and each have a V-shaped cut 15 and 16, the open ends of which face each other. The base section 10 incorporates a tab 17, which is die-cut from this section and is joined to the same along a folding line 18. The top panel 2 is also provided with two flaps 19 and 20 which are also cut from the top panel and are joined to the same along two folding lines 21 and 22. These two folding lines are shorter than the flaps 19 and 20 and are defined by a projection 23/24.

The two folding lines 3 and 4 defining the top panel 2 are divided up by cuts 25/26, which rims 27 of tub-like objects 28 engage when the multipack has been erected and filled as shown in cross-section in FIG. 2. The flaps 19 and 20, only flap 20 of which can be seen in FIG. 2, engage the area between the rims 27 and are locked below the respective rim by their projection 23/24. The flaps 13/14 and the tab 17 in the base sections 9/10 are pressed inwards between the tub-like objects 28, the tab 17 locking in the two V-shaped cut-out sections 15/16 of the flaps 13,14. The flaps 13/14 rest against the tub-like objects 28 and secure them in position effectively.

We claim:

1. Multipack made from board for at least four tub-like objects with rims that are arranged in two rows, said multipack comprising a top panel, two side panels and a base panel which base panel consists of an outer section (10) and an inner section (9) that overlap at least to some extent, cuts which the rims of the tub-like objects engage being provided in folding lines (3, 4) between the two side panels and the top panel, wherein the outer section (10) forming the base is provided with a tab (17) which is die-cut from the outer section (10) and is hinged to the outer section along a folding line (18) and wherein the inner section (9) has two hinged flaps (13, 14) that face each other and which two hinged flaps each have a cut-out section (15, 16) in a middle area of each hinged flap, which cut out section the tab (17) of the outer section (10) engages and locks with when the tab and flaps are folded between the tub-like objects (28).

2. Multipack according to claim 1, wherein the top panel (2) is provided in the middle with two flaps (19, 20) , which flaps are hinged to said top panel along folding lines 21 and 22, and which flaps face each other, are die-cut from the top panel (2) and engage the area between the rims (27) of the tub-like objects (28) when they are pressed inwards towards the centre of the multipack.

3. Multipack according to claim 2, wherein the two flaps (19, 20) in the top panel (2) are provided with a projection (23, 24), on either side of the folding lines (21, 22) with which they are hinged to the top panel (2) with which projection the flaps engage the rims (27) of the tub-like objects (28).

* * * * *